United States Patent [19]

Minor

[11] Patent Number: 4,583,442

[45] Date of Patent: Apr. 22, 1986

[54] DRUM LATCH ASSEMBLY

[75] Inventor: Thomas H. Minor, Reseda, Calif.

[73] Assignee: Remo, Inc., North Hollywood, Calif.

[21] Appl. No.: 670,305

[22] Filed: Nov. 13, 1984

[51] Int. Cl.[4] ..... G10D 13/02

[52] U.S. Cl. ..... 84/413; 84/415; 292/113; 292/DIG. 49

[58] Field of Search ..... 84/411–420; 292/113, DIG. 48, DIG. 49

[56] References Cited

U.S. PATENT DOCUMENTS

| | | | |
|---|---|---|---|
| 1,629,095 | 5/1927 | Danly | 84/411 R |
| 2,621,554 | 12/1952 | Way | 84/415 |
| 3,139,783 | 7/1964 | Grant et al. | 84/411 R |
| 3,169,788 | 2/1965 | Slan | 292/177 |
| 3,533,324 | 10/1970 | Price | 84/411 R |
| 4,122,747 | 10/1978 | Toshinori | 84/411 R |
| 4,218,081 | 8/1980 | Johnson | 292/66 |

FOREIGN PATENT DOCUMENTS

| | | | |
|---|---|---|---|
| 66830 | 5/1948 | Denmark | 84/413 |

*Primary Examiner*—Lawrence R. Franklin
*Attorney, Agent, or Firm*—Lyon & Lyon

[57] ABSTRACT

A tunable quick release mechanism for securing at least one drum head to a drum shell in an aesthetically pleasing manner. The mechanism may be used with a drum having either one drum head or two drum heads. An anchor affixed to the drum shell is connected to grip by means of lever. A pivoting lug fitted within retaining grooves formed within the grip is connected to means to clamp the drum head to the drum shell. Spring means may be used to secure the pivoting lug within the retaining grooves.

3 Claims, 7 Drawing Figures

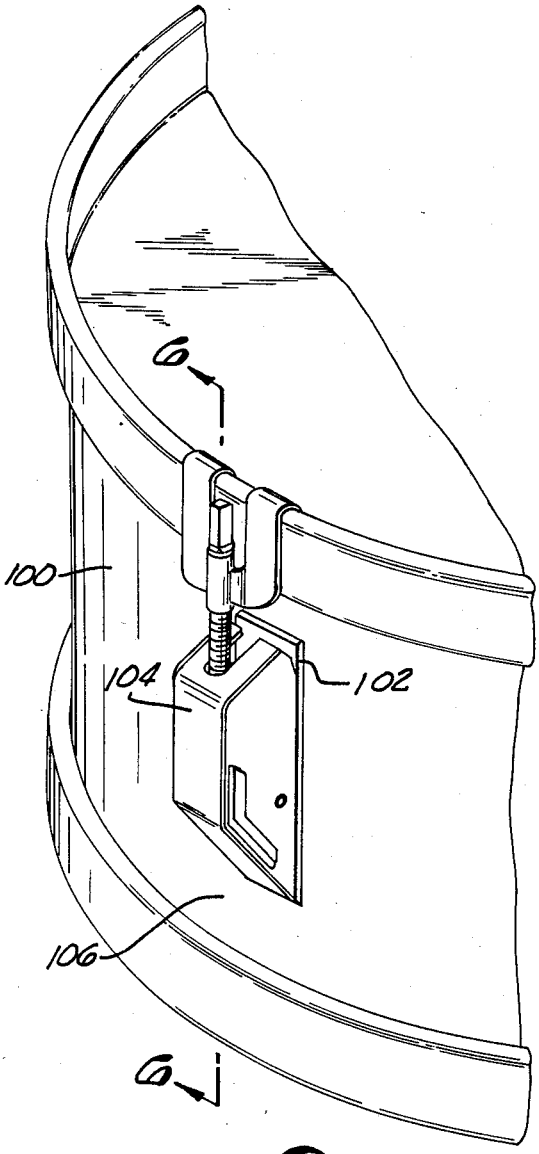
FIG. 5.
FIG. 6.
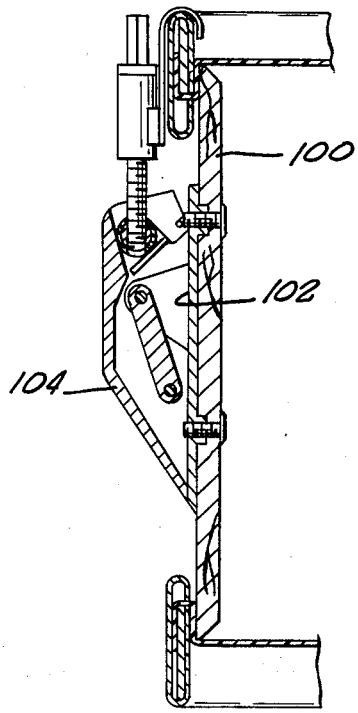
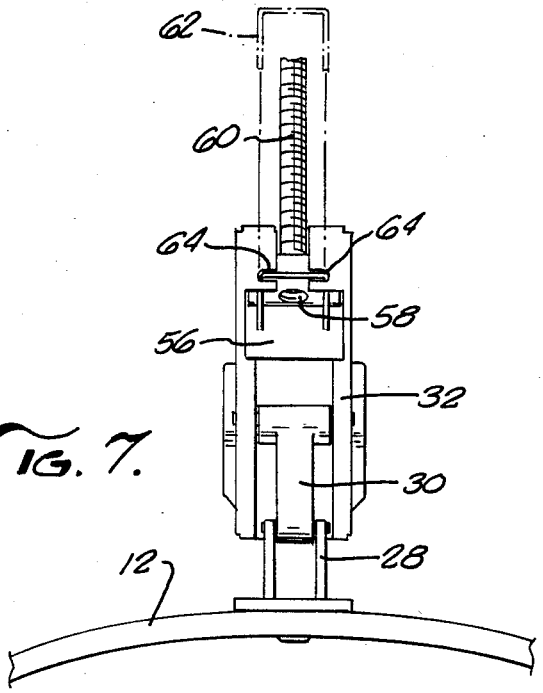
FIG. 7.

DRUM LATCH ASSEMBLY

BACKGROUND OF THE INVENTION

This invention relates to an improved means for mounting drumheads onto a drum.

Drumheads have been mounted to a drum shell by a variety of different means. In the past, drumheads were mounted by a drum hoop or rim which was tightened by screws to apply tension to the drumhead. The screws required an anchoring means affixed to the drum shell. As the screws were tightened, the pitch or tone of the drum was altered. In snare drums, which require two drumheads, the screws for both heads might be held by a single anchoring means affixed to the drum shell to avoid the additional cost associated with providing screws for each drumhead with separate anchoring means. Additionally, a dual function anchoring means provided a much more simplistic and aesthetically pleasing appearance.

In an effort to overcome the distinct disadvantages associated with tuning drumheads, pre-tuned drumheads were developed. Thus, U.S. Pat. Nos. 4,308,782; 4,416,181 and 4,469,001, the disclosures of which are specifically incorporated by reference herein, related to pre-tuned drumheads and the chemistry of such heads.

These improvements represented significant advances in the art because they allowed drummers to quickly replace broken drumheads or achieve a different pitch or tone. In addition, such drumheads could be held in place by a simple quick release snap since the tension of the drumhead would not need to be adjusted by screws. In mounting such heads to a drum, an apparatus for mounting a head on a musical instrument, as described in U.S. Ser. No. 416,069, filed Sept. 8, 1982, to Hartry, et al., assigned to the Assignee of this application, the disclosure of which is specifically incorporated herein, is particularly useful. These latches were utilized on drums manufactured by the Assignee under the trademark "PTS". However, these drums would utilize separate quick release snaps for both heads in a staggered fashion. This assembly is depicted in FIG. 1.

U.S. Pat. No. 3,533,324, assigned to the Assignee of the present invention, the disclosure of which is specifically incorporated herein by reference, describes a quickly removable drumhead for use on heads which are not pre-tuned. The quick release mechanism allowed the drum rim to be retensioned to the same tension which existed prior to replacement of the head. To the extent that the new drumhead differed from the former drumhead, tensioning could be adjusted by screws. However, this construction required part of the quick release mechanism to be removed from the drum in order to change drumheads. Thus, although this mechanism represented an improvement over prior devices, it still required a separate drum rim which had to be removed and replaced. Accordingly, there exists a need for a simple, quick means for replacing drumheads which may still be adjusted by tensioning if the drumhead is not pre-tuned.

In addition, there also exists a need for an improved quick release mechanism for snare drums which utilize two drumheads in a thin shell. Up until now, the narrow shell has prevented those skilled in the art from providing a snare drum with a quick release mechanism that did not require separate anchoring means for both drumheads. In addition, the narrow shell has served to accentuate the aesthetic considerations appurtenant to separate anchoring means for each drumhead. Accordingly, there exists a need for a quick release drumhead mechanism for snare drums which utilized a dual anchoring means.

SUMMARY OF THE INVENTION

In a drum having at least one drum head and a drum shell, it is desirable to be able to change the drum head in a fast and efficient manner. The invention herein includes an anchor which is fixedly attached to the drum shell. A grip is pivotally connected to the anchor by a lever means. The grip is essentially hollow and has corresponding retaining grooves formed in the interior sides thereof and at least one end of said grip. A pivoting lug is positioned within the retaining grooves in the grip. A connecting means such as a threaded rod having a head at one end and clamping means, such as clamping pawls engagable with the drum head are connected to the pivoting lug and extend through the grip in an aperture formed therethrough. Removable retaining means acts to secure the pivoting lug in the retaining grooves. A second embodiment includes a similar extension to that used in the first embodiment including the clamping pawls extending to a second drum head and passing through a second aperture in the grip.

It is therefore an object of the present invention to provide a quick release means for connecting a drum head to a drum shell.

It is a further object of the present invention to provide a quick release clamping means which may be utilized with drums having a shallow shell, such a snare drum, to retain both the upper and lower drum heads to the drum shell.

It is a further object of the present invention to provide a quick release drum head mechanism which will securely retain said drum heads to the drum shell in an aesthetically pleasing fashion.

It is a further object of the present invention to provide a quick release drum head mechanism which will allow the user to modify the tension in the drum head skin, thereby changing the drum pitch.

It is a further object of the present invention to provide a quick release drum latch mechanism which may be used with the conventional drum head assemblies. Other and more detailed objects of the invention shall be become apparent upon the examination of the disclosure contained herein.

DESCRIPTION OF THE DRAWINGS

FIG. 5 is a partial perspective view of a second embodiment of the invention;

FIG. 6 is cross-section taken substantially along lines 6—6 of FIG. 5; and FIG. 7 is a exploded view of the pivoting lug and retaining grooves of the quick release mechanism.

DESCRIPTION OF THE PREFERRED EMBODIMENTS

Figure 1:
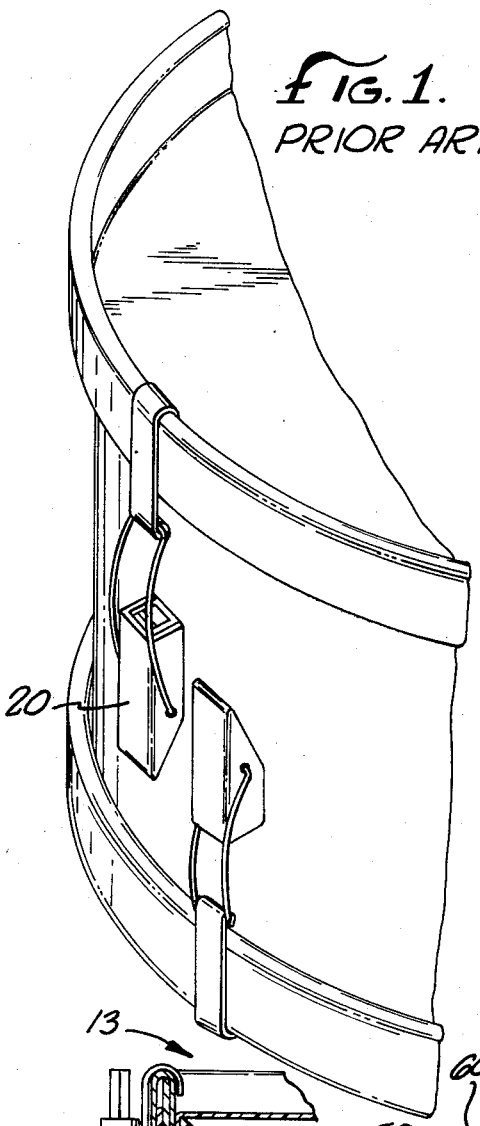
FIG. 1. PRIOR ART
FIG. 1 is a partial perspective view of a typical drum latch mechanism.
Figure 2:
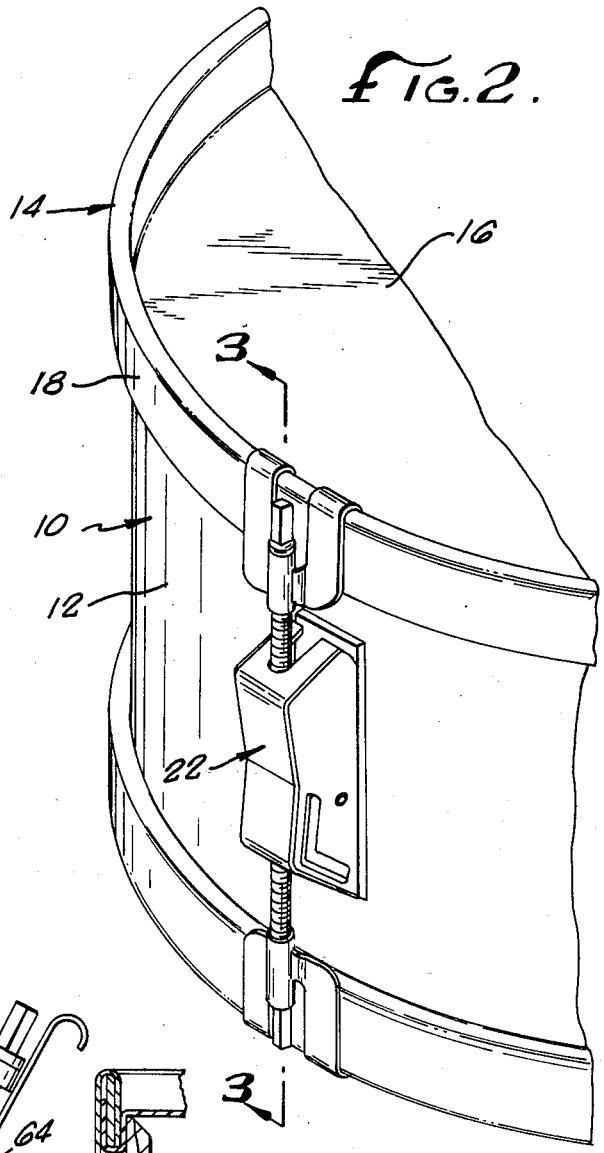
FIG. 2 is a partial perspective view of a first embodiment of the present invention.
Figure 3:
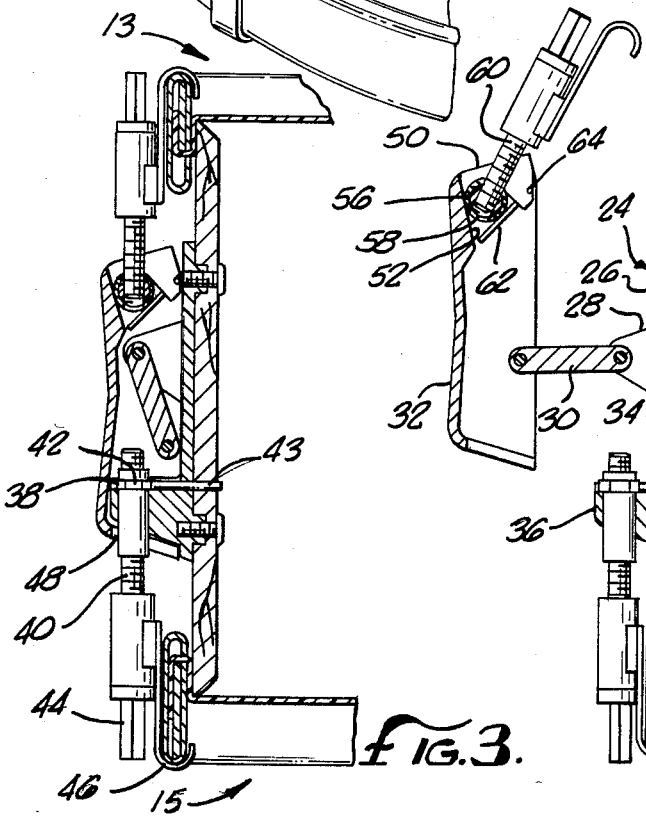
FIG. 3 is a cross-section taken substantially along lines 3—3 of FIG. 2 showing the first preferred embodiment in the closed position.
Figure 4:
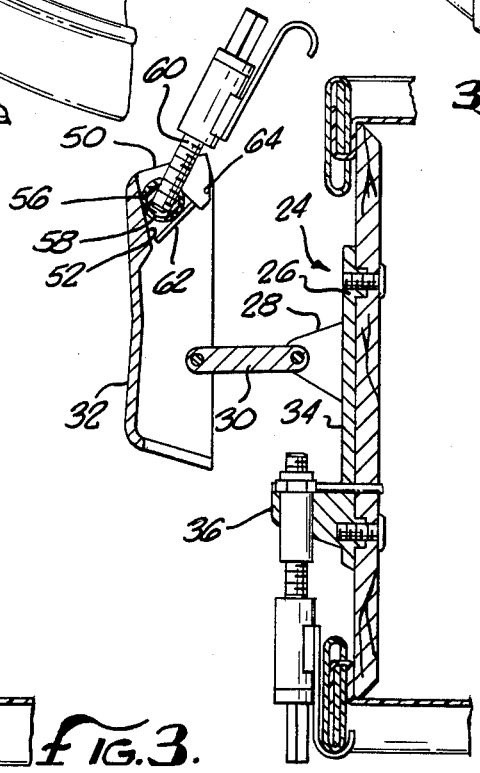
FIG. 4 is a cross-section taken substantially along lines 3—3 of FIG. 2 showing the first preferred embodiment of the latch in a substantially open position.

FIGS. 1 and 2 serve to illustrate the first preferred embodiment of the present invention. As shown in the figures, the drum 10 has a cylindrical shell 12 and a drum head assembly 14 at the upper 13 and lower 15 axial end of the drum shell 12. The drum head assembly, in the preferred embodiment, includes a drum skin 16 which is pretensioned onto a drum rim 18.

A typical drum utilizing pretensioned drum head assemblies 14 requires a series of clipping devices 20, such as those shown in FIG. 1, in order to maintain the position of each drum head assembly 18. Unfortunately, on many drums, such as a snare drum, the drum shell 12 is of insufficient axial length to enable the clipping devices 20 to be aligned co-axially. As a result, it is necessary to have a series of offset clipping devices 20 such as is shown in FIG. 1.

Applicant's first embodiment of its power lock device, shown in FIGS. 2–4 and 7 provides for a quick release mechanism on one drum head assembly 14, the upper drum head assembly 13, on a typical snare drum, providing the means for securely fastening both drum head assemblies 14 to the drum shell 12 in a secure and aesthetically appealing co-axial fashion. Thus, this first preferred embodiment is specifically adapted for a snare drum which only infrequently requires the bottom head to be changed or replaced. Having briefly described Applicant's first embodiment, its nature of operation and construction will now be described in detail.

The power lock device 22 includes an anchor assembly 24 rigidly affixed to the drum shell 12. The upper portion 26 of the anchor 24 includes, in the preferred embodiment, two parallel plates 28 which extend radially from the drum shell 12 and in the axial direction. A connecting lever 30 is pivotly connected between the parallel plates 28 and a power lock grip 32 at both ends by pin means. The lower portion 34 of the anchor device 24 has an extension 36 extending in the radial direction of the drum shell 12. In the preferred embodiment, the cross-section of the lower anchor extension is substantially "U" shaped. A hole 38 is formed through the extension 36 in the axial direction of the drum shell 12.

A threaded securing rod 40 is positioned through the hole 38 and retained in position by retaining means such as a nut 42 and a retaining device 43. The opposite end of the threaded securing rod 40 has a head 44 formed thereon. Clamping pawls 46 are slidably retained on the threaded securing rod 40 between the lower anchor extension 36 and the securing rod head 44. The clamping pawls 46 act to engage the rim 18 of the drum head assembly 14.

The lower end of the power lock grip 32 has a slot 48 therein to accommodate the threaded securing rod 40 when the power lock grip 32 is in the fully closed position. Similarly, the upper end of the power lock grip 32 has a slot 50 in its upper face. A retaining groove 52 is formed in the walls adjacent to each longitudinal side 54 of the power lock grip 32. A pivoting lug 56 having a threaded hole 58 radially therethrough, is attached to a second threaded securing rod 60 which includes a head on one end and clamping pawls slidable thereon as set forth above.

In the preferred embodiment, the pivoting lug 56 and second threaded securing rod 60 is fitted into the retaining groove 52 and slot 50, respectively, of the power lock grip 32. A locking spring 62 fitted through holes 64 in the upper face of the power lock grip 32 acts to retain the pivoting lug 56 in the retaining groove 52. A drum key can be used to adjust the tension by which the clamping pawls 46 engage the rim 18. Thus, a drum key (not shown) may be used to turn the securing rod head 44 and thereby change the tension on the drumhead skin 16.

Having fully described the construction of the first embodiment its operation will now be described. Upon desiring to change the upper drum head assembly 13, the power locking device 22 may be disengaged by exerting an upward and radially outward force on the power lock grip 32. Movement of the power lock grip 32 will be accomplished by pivoting about the connecting lever 30 such that the upper threaded securing rod 60 and its clamping pawls will be able to be disengaged from the drum rim 18, thereby enabling the upper drum head assembly 13 to be quickly changed.

On the rare occasion when it is necessary to change the lower drum head assembly 15, the lower clamping pawls 46 may be released by threadedly disengaging the lower threaded securing rod 40 from its retaining means 42 in the lower anchor portion 34.

It is also possible to use the power lock device 22 shown herein with a conventional drum head assembly (not shown) having a rim with anchor holes formed therethrough. The clamping pawls are removed from the appropriate threaded securing rod such that the rod is positioned through the drum rim anchor hole. By assembling the power lock device 22 without the locking spring, designated as 62 in the above description, the securing rod and the pivoting lug will be readily disengaged from the power lock grip when the grip is moved to its disengaged position. Thus, it is possible to maintain the quick release features of the power lock device 22 while accommodating the conventional drum rim and anchor hole configuration.

As shown in FIGS. 5–7, it is also sometimes desirable to have a quick release locking mechanism on drums 100 in which having a combined upper and lower drum head assembly retaining means is not desirable. In such situations, a slightly modified version of Applicant's first embodiment may be utilized to accommodate such a drum.

The anchor 102 of this second preferred embodiment is essentially the same as the upper portion of Applicant's anchor device 26 in its first embodiment without the anchor lower portion 34. Similarly, a modified power lock grip 104 having a similar upper portion as that described in the first preferred embodiment and having a lower portion which is truncated towards the shell of the drum 106, provides the secure retention and quick release features of the first preferred embodiment while providing an aesthetically pleasing appearance.

The remaining construction of the second preferred embodiment is substantially similar to that of the first preferred embodiment such that Applicant hereby incorporates said disclosure by reference.

Similar to the first preferred embodiment, the second preferred embodiment may also be used in conjunction with typical older drum rim mounting configurations, such as having an anchor hole through the drum rim or an extension thereof. Again, similar to the first preferred embodiment, removal of the retaining spring pin and clamping pawls enables the power lock grip 104 of the second preferred embodiment to be used in conjunction with such a configuration.

In any of the above embodiments, the tension in applicant's threaded securing rod device may be modified by using a drum key to alter the tension in the drum head skin. This enables the user to modify the head tension, and thereby the pitch of the drum.

Applicant further notes that prior art devices may be used in conjunction with Applicant's power locking grip devices. Applicant therefore does intend to limit its device to be used on a drum to the exclusion of prior devices. Therefore, any use of Applicant's power lock device, or devices obvious to those skilled in the art from Applicant's device, are hereby incorporated by reference.

The embodiments of the invention described hereinabove are intended for purposes of example only and should not be construed to limit the scope of the claims appended hereto.

I claim:

1. A drum latch for connecting a pair of drum heads to a drum shell, said latch comprising, an anchor, said anchor being fixedly secured to the drum shell, a grip, said grip being substantially hollow and having at least one pair of corresponding retaining grooves formed in two parallel interior sides thereof, said grip also having an aperture in the ends thereof, a lever means pivotally connected between said anchor and said grip, a clamping means engagable with the drum heads, a first threaded rod having a head formed at one end thereof extending between said anchor and a first said clamping means and passing through a first said aperture in said grip, said first clamping means being engagable with the first drum head, a pivoting lug positioned within said corresponding pair of retaining grooves, a second threaded rod having a head formed on an end thereof extending between said pivoting lug and a second said clamping means engagable with the second drum head and passing through a second said aperture in said grip and removable means to retain said pivoting lug in said retaining grooves.

2. A drum latch for connecting a drum head to a drum shell, said latch comprising, an anchor, said anchor being fixedly secured to the drum shell, a grip, said grip being substantially hollow and having one pair of corresponding retaining grooves formed in two parallel interior sides thereof, a lever means pivotally connected between said anchor and said grip, a pivoting lug positioned within said corresponding pair of retaining grooves, tunable clamping means connecting said pivoting lug to the drum head and removable means to retain said pivoting lug in said retaining grooves.

3. The drum latch as set forth in claim 2 wherein a second tunable-clamping means extends between said anchor and a second drum head.

* * * * *